US007638041B2

(12) United States Patent
Boyer et al.

(10) Patent No.: US 7,638,041 B2
(45) Date of Patent: Dec. 29, 2009

(54) PROCESS FOR TREATING CRACKED NAPHTHA STREAMS

(75) Inventors: Christopher C. Boyer, Houston, TX (US); Gary G. Podrebarac, Houston, TX (US); William M. Cross, Jr., Seabrook, TX (US); Arvids Judzis, Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 385 days.

(21) Appl. No.: 11/057,659

(22) Filed: Feb. 14, 2005

(65) Prior Publication Data

US 2006/0180502 A1 Aug. 17, 2006

(51) Int. Cl.
*C10G 45/02* (2006.01)

(52) U.S. Cl. ..... 208/208 R; 208/213

(58) Field of Classification Search ..... 208/208 R, 208/209, 210, 213
See application file for complete search history.

(56) References Cited

U.S. PATENT DOCUMENTS

| | | | | |
|---|---|---|---|---|
| 5,320,742 | A | 6/1994 | Fletcher et al. | 208/89 |
| 5,595,634 | A | 1/1997 | Hearn et al. | 203/29 |
| 5,597,476 | A | 1/1997 | Hearn et al. | 208/208 R |
| 5,807,477 | A | 9/1998 | Hearn et al. | 208/238 |
| 6,083,378 | A | 7/2000 | Gildert et al. | 208/209 |
| 6,231,752 | B1 * | 5/2001 | Putman | 208/213 |
| 6,416,658 | B1 * | 7/2002 | Maraschino et al. | 208/213 |
| 6,416,659 | B1 | 7/2002 | Groten et al. | 208/213 |
| 6,440,299 | B2 | 8/2002 | Hearn et al. | 208/189 |
| 6,444,118 | B1 | 9/2002 | Podrebarac et al. | 208/210 |
| 6,495,030 | B1 | 12/2002 | Podrebarac | 208/218 |
| 6,676,830 | B1 | 1/2004 | Vichailak et al. | 208/210 |
| 6,824,676 | B1 * | 11/2004 | Podrebarac et al. | 208/213 |
| 6,855,853 | B2 | 2/2005 | Groten et al. | 585/264 |
| 6,881,324 | B2 | 4/2005 | Smith, Jr. | 208/209 |
| 2004/0000506 | A1 | 1/2004 | Podrebarac et al. | 208/211 |
| 2004/0040889 | A1 | 3/2004 | Groten | 208/210 |
| 2004/0055933 | A1 * | 3/2004 | Groten et al. | 208/57 |
| 2004/0055935 | A1 | 3/2004 | Bakshi | 208/213 |
| 2004/0188327 | A1 | 9/2004 | Groten | 208/210 |

OTHER PUBLICATIONS

Notification of Transmittal of International Search Report and Written Opinion, International Search Report, and Written Opinion of the International Searching Authority for Application No. PCT/US05/44340 mailed Aug. 6, 2007 (9 pages).

* cited by examiner

*Primary Examiner*—Glenn Caldarola
*Assistant Examiner*—Randy Boyer
(74) *Attorney, Agent, or Firm*—Osha Liang LLP

(57) ABSTRACT

A selected boiling range fluid catalytically cracked naphtha stream is subjected to simultaneous splitting, thioetherification of a light boiling range naphtha and selective hydrogenation of the dienes in a medium boiling range naphtha.

7 Claims, 6 Drawing Sheets

PROCESS FOR TREATING CRACKED NAPHTHA STREAMS

BACKGROUND OF THE INVENTION

1. Field of The Invention

The present invention relates to a process for concurrently fractionating and treating a full range fluid catalytically cracked naphtha stream. More particularly a selected boiling range fluid catalytically cracked naphtha stream is subjected to a process for the simultaneous thioetherification and splitting into a light boiling range naphtha, a medium boiling range naphtha and a heavy boiling range naphtha; and the selective hydrogenation of the dienes in the medium boiling range naphtha.

2. Related Information

Petroleum distillate streams contain a variety of organic chemical components. Generally the streams are defined by their boiling ranges which determine the compositions. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds.

Cracked naphtha as it comes from the catalytic cracker has a relatively high octane number as a result of the olefinic and aromatic compounds contained therein. In some cases this fraction may contribute as much as half of the gasoline in the refinery pool together with a significant portion of the octane. Such cracked-stream sources such as from FCC, coker, visbreaker (and the like) typically contain around 90% of all of the "destination sulfur" that would have reported to refinery gasoline in the absence of all desulfurization treatment. The sulfur impurities require removal, usually by hydrotreating, in order to comply with product specifications or to ensure compliance with environmental regulations.

Hydrotreating is a broad term which includes saturation of olefins and aromatics and the reaction of organic nitrogen compounds to form ammonia. The reaction of organic sulfur compounds in a refinery stream with hydrogen over a catalyst to form $H_2S$ is typically called hydrodesulfurization. However hydrodesulfurization is included and is sometimes simply referred to as hydrotreating. The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical HDS unit:

$$RSH+H_2 \longrightarrow RH+H_2S \quad (1)$$

$$RCl+H_2 \longrightarrow RH+HCl \quad (2)$$

$$2RN+4H_2 \longrightarrow 2RH+2NH_3 \quad (3)$$

$$ROOH+2H_2 \longrightarrow RH+2H_2O \quad (4)$$

Typical operating conditions for naphtha HDS reactions are:

| | |
|---|---|
| Temperature, ° F. | 450-650 |
| Pressure, psig | 250-750 |
| $H_2$ recycle rate, SCF/bbl | 700-2000 |
| Fresh $H_2$ makeup, SCF/bbl | 150-500 |

After the hydrotreating is complete, the product may be fractionated or simply flashed to release the hydrogen sulfide and collect the now desulfurized naphtha.

In addition to supplying high octane blending components the cracked naphthas are often used as sources of olefins in other processes such as etherifications. The conditions of hydrotreating of the naphtha fraction to remove sulfur will also saturate some of the olefinic compounds in the fraction, thereby reducing the octane and causing a loss of source olefins.

Various proposals have been made for removing sulfur while retaining the more desirable olefins. Since the olefins in the cracked naphtha are mainly in the low boiling fraction of these naphthas and the sulfur containing impurities tend to be concentrated in the high boiling fraction the most common solution has been prefractionation prior to hydrotreating. The prefractionation produces a light boiling range naphtha (LCN) which boils in the range of $C_5$ to about 250° F. and a heavy boiling range naphtha which boils in the range of from about 250-475° F. (HCN).

The predominant light or lower boiling sulfur compounds are mercaptans (RSH) while the heavier or higher boiling compounds are thiophenes and other heterocyclic compounds. The separation by fractionation alone will not remove the mercaptans. However, in the past the mercaptans have been removed by oxidative processes involving caustic washing. A combination oxidative removal of the mercaptans followed by fractionation and hydrotreating of the heavier fraction is disclosed in U.S. Pat. No. 5,320,742. In the oxidative removal of the mercaptans the mercaptans are converted to the corresponding disulfides.

In addition to treating the lighter portion of the naphtha to remove the mercaptans, it has been traditional to use the light portion as feed to a catalytic reforming unit to increase the octane number if necessary. Also the lighter fraction may be subjected to further separation to remove the valuable $C_5$ olefins (amylenes) which are useful in preparing ethers.

U.S. Pat. No. 6,083,378 discloses a naphtha splitter as a distillation column reactor to treat a portion or all of the naphtha to remove the organic sulfur compounds contained therein. The catalyst is placed in the distillation column reactor such that the selected portion of the naphtha is contacted with the catalyst and treated. The catalyst may be placed in the rectification section to treat the lighter boiling range components only, in the stripping section to treat the heavier boiling range components only, or throughout the column to widely treat the naphtha. In addition the distillation column reactor may be combined with standard single pass fixed bed reactor (s) or another distillation column reactor to fine tune the treatment.

In hydrodesulfurizations it is known that $H_2S$ can recombine to form mercaptans thus increasing the amount of sulfur in the product. In U.S. Pat. No. 6,416,658 a full boiling range naphtha stream is subjected to simultaneous hydrodesulfurization and splitting into a light boiling range naphtha and a heavy boiling range naphtha followed by further hydrodesulfurization by contacting the light boiling range naphtha with hydrogen in countercurrent flow in a fixed bed of hydrodesulfurization catalyst to remove recombinant mercaptans which are formed by the reverse reaction of $H_2S$ with olefins in the naphtha during the initial hydrodesulfurization. In particular the entire recovered portion of the light naphtha from a reaction distillation column hydrodesulfurization is further contacted with hydrogen in countercurrent flow in a fixed bed of hydrodesulfurization catalyst.

It is an advantage of the present invention that the sulfur may be removed from the light naphtha portions of the stream without any substantial loss of the valuable lighter olefins. It is a particular advantage that recombinant mercaptans are not a concern in the present process of sulfur removal from the LCN. It is a further advantage that the dienes are reduced in the MCN.

SUMMARY OF THE INVENTION

Briefly the present invention is an improvement in a catalytic distillation hydrodesulfurization process comprising:

(a) splitting the fluid catalytic cracked naphtha into at least three fractions comprising a light cracked naphtha, a medium cracked naphtha and a heavy cracked naphtha;

(b) treating the light cracked naphtha to react a portion of the mercaptans contained therein with a portion of the dienes contained therein to form sulfides; and (c) treating the medium cracked naphtha to hydrogenate a portion of the dienes contained therein.

Typically steps (a) and (b) will be carried out concurrently in a distillation column reactor having a thioetherification catalyst in the upper or rectification portion. The selective hydrogenation of step (c) may also be carried out in the same distillation column reactor by placing a selective hydrogenation catalyst in the mid portion. If the hydrogenation is to be carried out in the same reactor then the cracked naphtha would be fed below the selective hydrogenation catalyst to prevent the HCN from contacting that catalyst and thus hydrogenating the HCN. Hydrogenation of the HCN would adversely affect the hydrogenation catalyst. Also a divided wall column reactor can be used to allow only boilup of the middle boiling range naphtha (MCN) into the selective hydrogenation catalyst bed and bypass the downflowing HCN.

DETAILED DESCRIPTION OF THE PREFERRED EMBODIMENT

Figure 1:
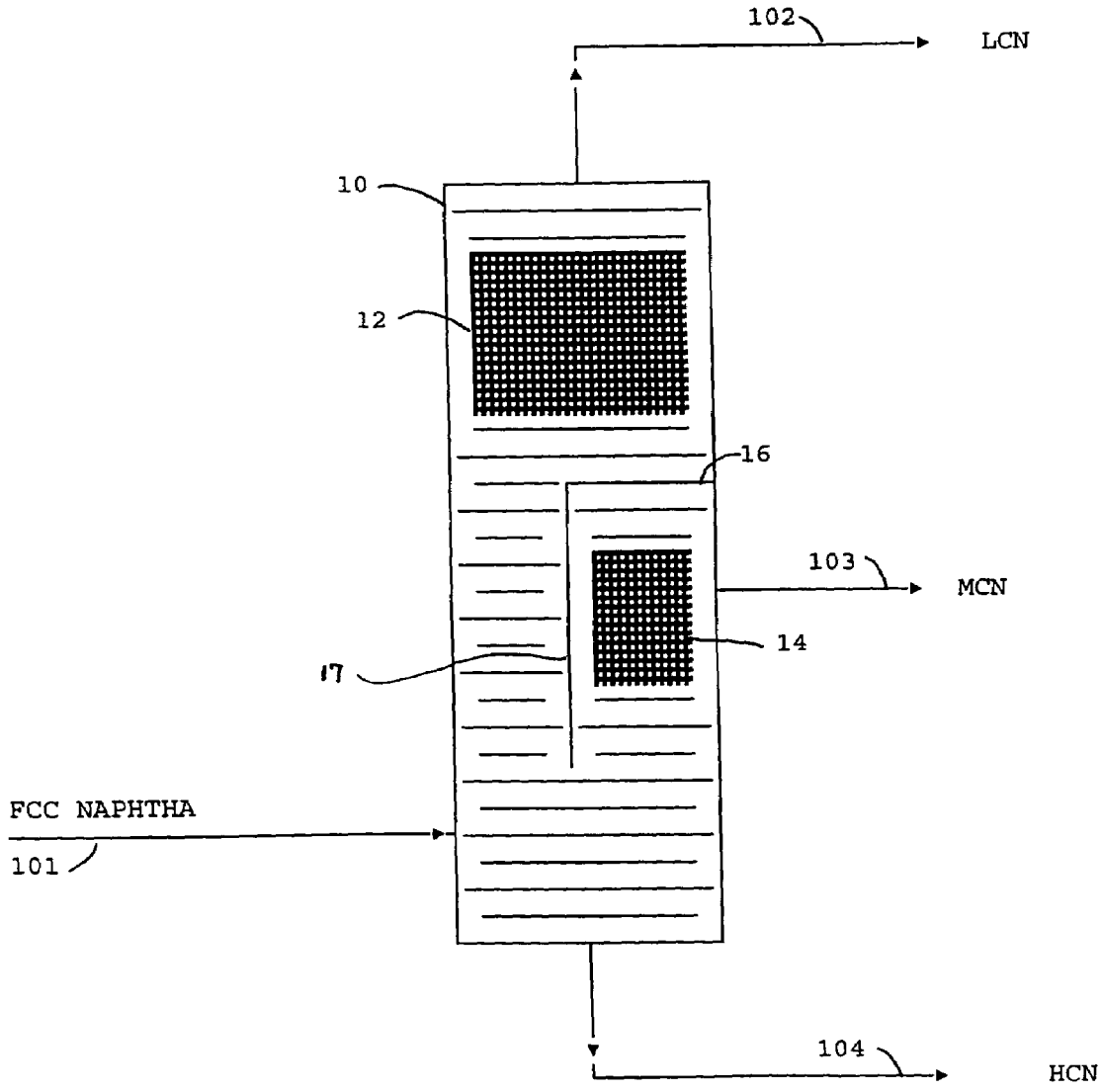
FIG. 1 is a flow diagram in schematic form of one embodiment of the present invention utilizing a single divided wall column for upflow and downflow contact.

The feed to the process comprises a sulfur-containing petroleum fraction from a fluidized bed catalytic cracking unit (FCCU) which boils in the gasoline boiling range ($C_5$ to 450° F., i.e., fluid cracked naphtha). Generally the process is useful on the naphtha boiling range material from catalytic cracker products because they contain the desired olefins and unwanted sulfur compounds. Straight run naphthas have very little olefinic material, and unless the crude source is "sour", very little sulfur.

The sulfur content of the catalytically cracked fractions will depend upon the sulfur content of the feed to the cracker as well as the boiling range of the selected fraction used as feed to the process. Lighter fractions will have lower sulfur content than higher boiling fractions. The front end of the naphtha contains most of the high octane olefins but relatively little of the sulfur. The sulfur components in the front end are mainly mercaptans and some dialkylsulfides. Typical of those compounds are: methyl mercaptan (b.p. 43° F.), ethyl mercaptan (b.p. 99° F.), n-propyl mercaptan (b.p. 154° F.), isopropyl mercaptan (b.p. 135-140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.), iso-amyl mercaptan (b.p. 250° F.), n-amyl mercaptan (b.p. 259° F.), α-methylbutyl mercaptan (b.p. 234° F.), α-ethylpropyl mercaptan (b.p. 293° F.), n-hexyl mercaptan (b.p. 304° F.), 2-mercapto hexane (b.p. 284° F.), and 3-mercapto hexane (b.p. 135° F.). Typical sulfur compounds found in the heavier boiling fraction include the heavier mercaptans, thiophenes sulfides and disulfides.

The lower boiling portion of the naphtha which contains most of the valuable olefins is therefore not subjected to hydrodesulfurization catalysts but to a less severe treatment wherein the mercaptans contained therein are reacted with diolefins contained therein to form dialkylsulfides (thioetherification) which are higher boiling and can be removed with the heavier naphtha. The thioetherification reaction is preferably carried out in a bed of catalyst in the upper portion or rectification section of a naphtha splitter in which a light cracked naphtha (LCN) boiling in the range of C5 to about 150° F. is taken as overheads.

It has been found that the entire heavier end of the fluid cracked naphtha stream (150-450° F. boiling range) cannot be treated effectively in a downflow thioetherification reactor or hydrodesulfurization reactor because the high sulfur levels deactivated the nickel thioetherification catalyst and the dienes tended to foul the nickel-molybdenum hydrodesulfurization catalyst.

A MCN cut boiling from about 150 to 250° F. is taken as a sidedraw and the dienes contained therein are subjected to selective hydrogenation. This cut contains the highest concentration of dienes and has a lower total sulfur content than the full range naphtha. The removal of the dienes allows the MCN to be recombined with the heavy cracked naphtha (HCN) bottoms which boils from about 250-450° F. to be further treated in a hydrodesulfurization reactor. The feed to the splitter is such that the MCN does not contact the thioetherification catalyst and the HCN does not contact the selective hydrogenation catalyst. Accomplishing this will be discussed further.

Thioetherification and Selective Hydrogenation Catalysts

Catalysts which are useful in the mercaptan-diolefin reaction and the selective hydrogenation of dienes include the Group VIII metals. Generally the metals are deposited as the oxides on an alumina support.

A preferred catalyst for the thioetherification reaction in CD mode is 54 wt. % Ni on 8 to 14 mesh $Al_2O_3$ (alumina) spheres, supplied by Calcicat designated as E-475-SR. Typical physical and chemical properties of the catalyst as provided by the manufacturer are as follows:

TABLE I

| | |
|---|---|
| Designation | E-475-SR |
| Form | Sphere |
| Nominal size | 8 × 14 mesh |
| Ni wt. % | 54 |
| Support | alumina |

Hydrogen must be fed to the reactor at a rate to the reactor must be sufficient to maintain the reaction, but kept below that which would cause flooding of the column which is understood to be the "effectuating amount of hydrogen" as that term is used herein. Generally the mole ratio of hydrogen to diolefins and acetylenes in the feed is at least 1.0 to 1.0 and preferably 2.0 to 1.0.

The thioetherification catalyst also catalyzes the selective hydrogenation of polyolefins contained within the light cracked naphtha and to a lesser degree the isomerization of some of the mono-olefins. Using the preferred Ni catalyst the relative rates of reaction for various compounds are in the order of from faster to slower:

(1) reaction of diolefins with mercaptans (2) hydrogenation of diolefins (3) isomerization of the mono-olefins (4) hydrogenation of the mono-olefins.

The reaction of interest is the reaction of the mercaptans with diolefins. In the presence of the catalyst the mercaptans will also react with mono-olefins. However, there is an excess of diolefins to mercaptans in the light cracked naphtha feed and the mercaptans preferentially react with them before reacting with the mono-olefins. The equation of interest which describes the reaction is:

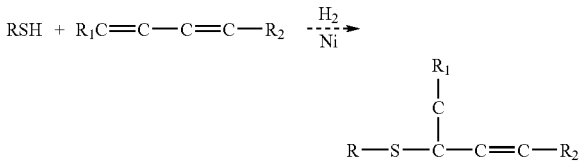

where $R_1$ or $R_2$ can be either an alkyl group or a hydrogen atom.

This may be compared to the reaction described below which consumes hydrogen. The only hydrogen utilized in the removal of the mercaptans in the thioetherification is that necessary to keep the catalyst in the reduced "hydride" state. In the concurrent hydrogenation of the dienes, hydrogen is consumed.

Selective Hydrogenation Catalyst

The catalyst may be used as individual Group VIII metal component or in admixture with each other or modifiers as known in the art, particularly those in Group VIB and IB such as hydrogenation catalysts of the type characterized by platinum, palladium, rhodium or mixtures thereof. Generally the metals are deposited as the oxides on an alumina support. The supports are usually small diameter extrudates or spheres, typically alumina. Catalysts preferred for the selective hydrogenation of diolefins are alumina supported palladium catalysts.

Catalyst Structures

The catalyst typically is in the form of extrudates having a diameter of 1/8, 1/16 or 1/32 inches and an L/D of 1.5 to 10. The catalyst also may be in the form of spheres having the same diameters. In their regular form they present too compact a mass and are preferably prepared in the form of a catalytic distillation structure. The catalytic distillation structure must be able to function as catalyst and as mass transfer medium.

When the catalysts are used within a distillation column reactor, they are preferably prepared in the form of a catalytic distillation structure. The catalytic distillation structure must be able to function as catalyst and as mass transfer medium. The catalyst is preferably supported and spaced within the column to act as a catalytic distillation structure. A variety of catalyst structures for this use are disclosed in U.S. Pat. Nos. 4,443,559; 4,536,373; 5,057,468; 5,130,102; 5,133,942; 5,189,001; 5,262,012; 5,266,546; 5,348,710; 5,431,890; and 5,730,843 which are incorporated herein by reference.

A preferred structure is that shown in U.S. Pat. No. 5,730,843 which is incorporated by reference. As disclosed therein the structure comprises a rigid frame made of two substantially vertical duplicate grids spaced apart and held rigid by a plurality of substantially horizontal rigid members and a plurality of substantially horizontal wire mesh tubes mounted to the grids to form a plurality of fluid pathways among the tubes. At least a portion of the wire mesh tubes contain a particulate catalytic material. The catalyst within the tubes provides a reaction zone where catalytic reactions may occur and the wire mesh provides mass transfer surfaces to effect a fractional distillation. The spacing elements provide for a variation of the catalyst density and loading and structural integrity and provides ample vapor and liquid throughput capability.

Referring now to the figures, specific embodiments of the process of the invention are shown.

In FIG. 1 shows an embodiment wherein the fluid cracked naphtha is split into three fractions and both the thioetherification and selective hydrogenation are carried out concurrently with the fractionation within one divided wall distillation column reactor 10. The full range fluid cracked naphtha is fed to a divided wall distillation column reactor 10 via flow line 101, preferably below the catalysts beds. Hydrogen may be fed either with the feed or at the bottom of the reactor, and is not shown. The LCN is distilled upward into the rectification section of the divided wall distillation column reactor which contains a bed 12 of thioetherification catalyst. The diolefins in the LCN react with the mercaptans to form sulfides which are distilled back down into the lower portion of the reactor. The treated LCN is removed as overheads via flow line 102. A wall 17 divides the column in the mid section with a bed 14 of selective hydrogenation catalyst on one side of the wall. A tray 16 covers the portion containing the catalyst bed 14. The tray 16 allows vapors to flow upward into the rectification section but prevents liquid from flowing downward over the catalyst from the rectification section. There is no downcomer to bring outside liquid into the bed. The only liquid flowing is from internal reflux within that portion of the divided wall column. This ensures that no HCN contacts the catalyst bed 14 and allows for selective hydrogenation of the MCN within the bed. A diene depleted MCN is withdrawn as a side stream via flow line 103. The HCN is removed from the divided wall column reactor via flow line 104.

Figure 2:
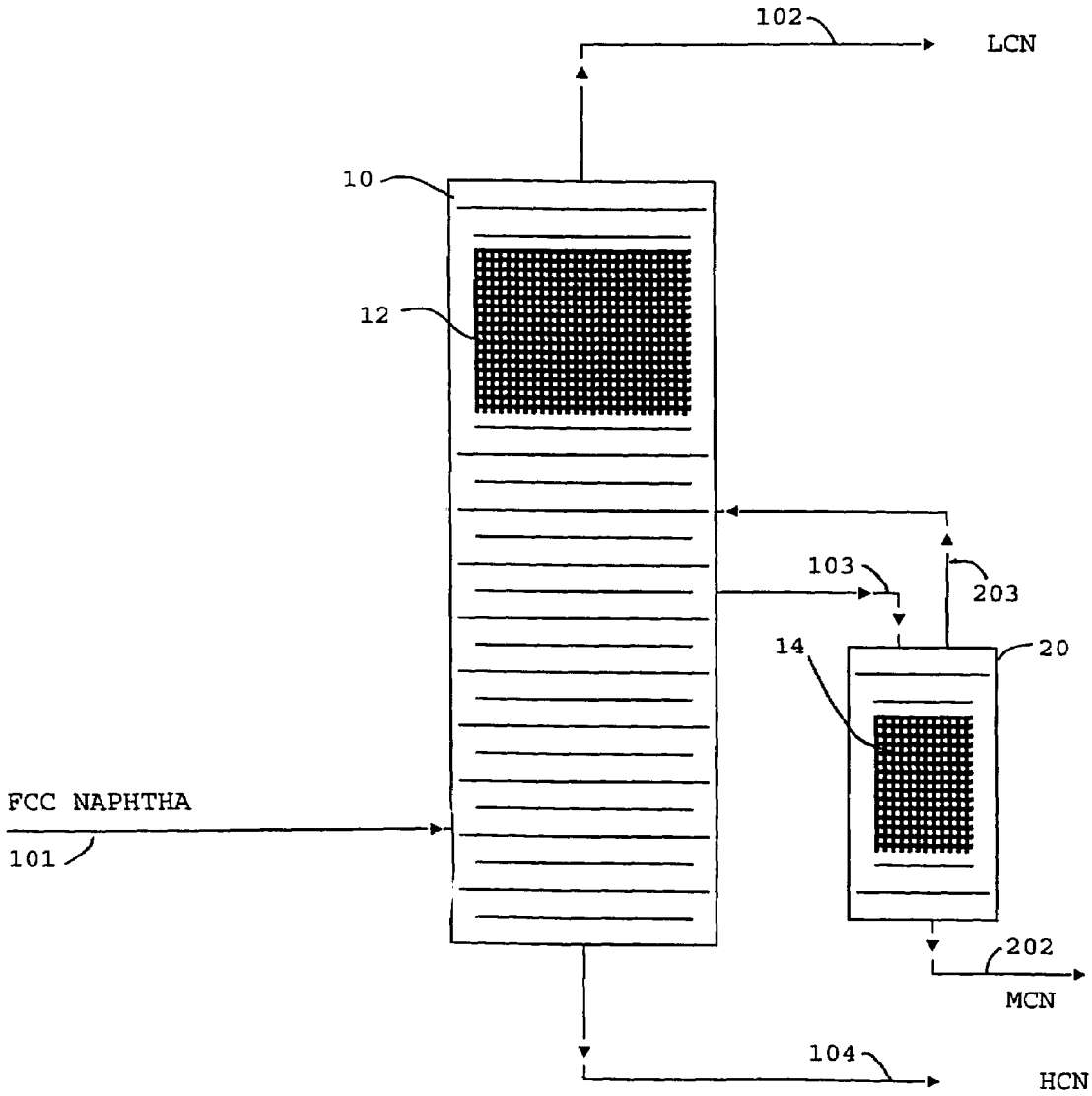
FIG. 2 is a flow diagram in schematic form of another embodiment of the present invention utilizing a first distillation column reactor for the thioetherification and a side stripper reactor for the MCN hydrogenation.

Referring now to FIG. 2 a second embodiment of the invention is shown. Instead of placing the selective hydrogenation catalyst bed 14 in a divided wall column it is placed in a side stripper 20. As in the first embodiment a full range cracked naphtha is fed to a distillation column reactor 10 via flow line 101. Hydrogen is fed as described above. A bed 12 of thioetherification catalyst is placed in the rectification section to react the diolefins contained within the LCN with the mercaptans to form disulfides which are distilled downward into the column. A sidedraw of MCN is taken via flow line 103 and fed to the side stripper 20 which contains the bed 14 of selective hydrogenation catalyst. Light material is stripped from the MCN and taken as an overheads via flow line 203 and fed back to distillation column reactor 10. At the same time the dienes in the MCN are hydrogenated and the MCN removed as bottoms via flow line 202 and may be combined with the HCN which has been taken as bottoms from the distillation column reactor 10 via flow line 104.

Figure 3:
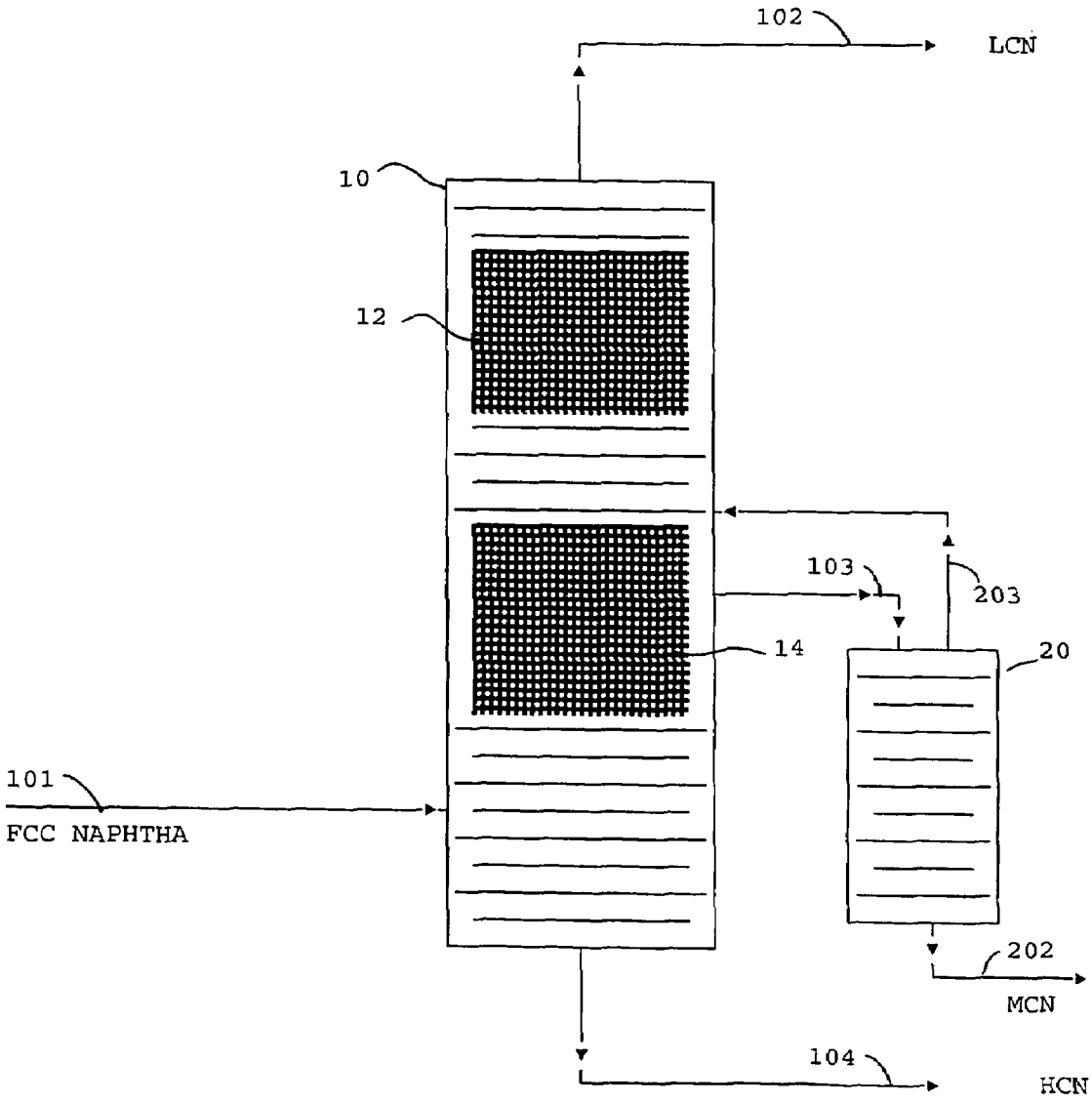
FIG. 3 is a flow diagram in schematic form of another embodiment of the present invention utilizing a single distillation column reactor having two catalyst beds but fed below the hydrogenation bed.

Referring now to FIG. 3 an embodiment similar to that shown in FIG. 2 is shown. The feed line 101 is toward the lower end of the distillation column reactor 10 and the bed 14 of selective hydrogenation catalyst is within the middle portion of the reactor 10. The sidedraw MCN is stripped in side stripper 20 and removed as a bottoms via flow line 202.

Figure 4:
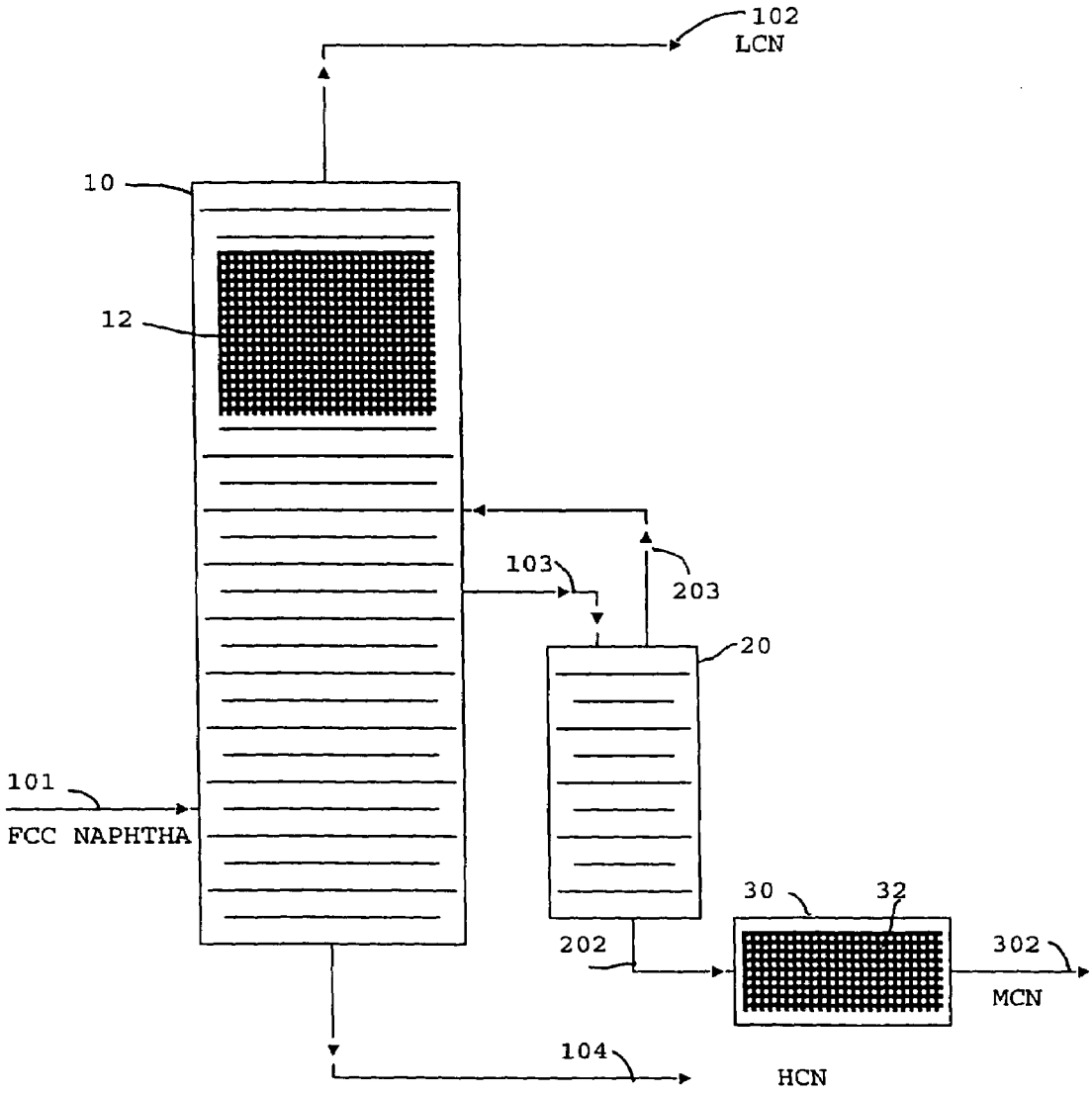
FIG. 4 is a flow diagram in schematic form of another embodiment of the present invention utilizing a first distillation column reactor for the thioetherfication and a single pass fixed bed reactor for the selective hydrogenation of the MCN.

Referring now to FIG. 4 another similar embodiment to that of FIG. 3 is shown. The only differences are that the full boiling range cracked naphtha is fed near the bottom of the distillation column reactor 10 and that the bed 32 of selective hydrogenation catalyst is located in a standard single pass fixed bed reactor 30 and the MCN is removed via flow line 302.

Figure 5:
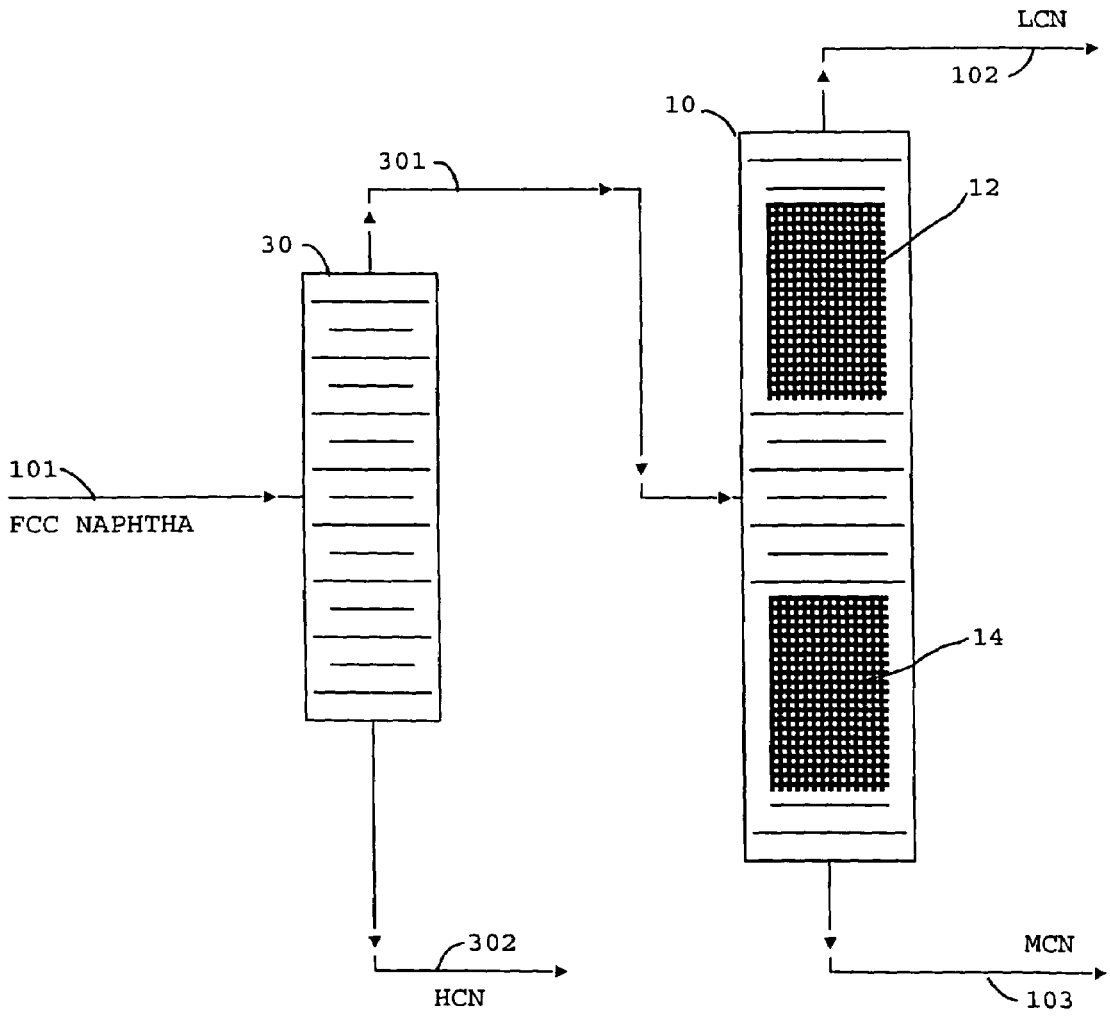
FIG. 5. is a flow diagram in schematic form of another embodiment of the present invention utilizing a single distillation column reactor having two catalyst beds but having the HCN removed prior to feeding the distillation column reactor.
Figure 6:
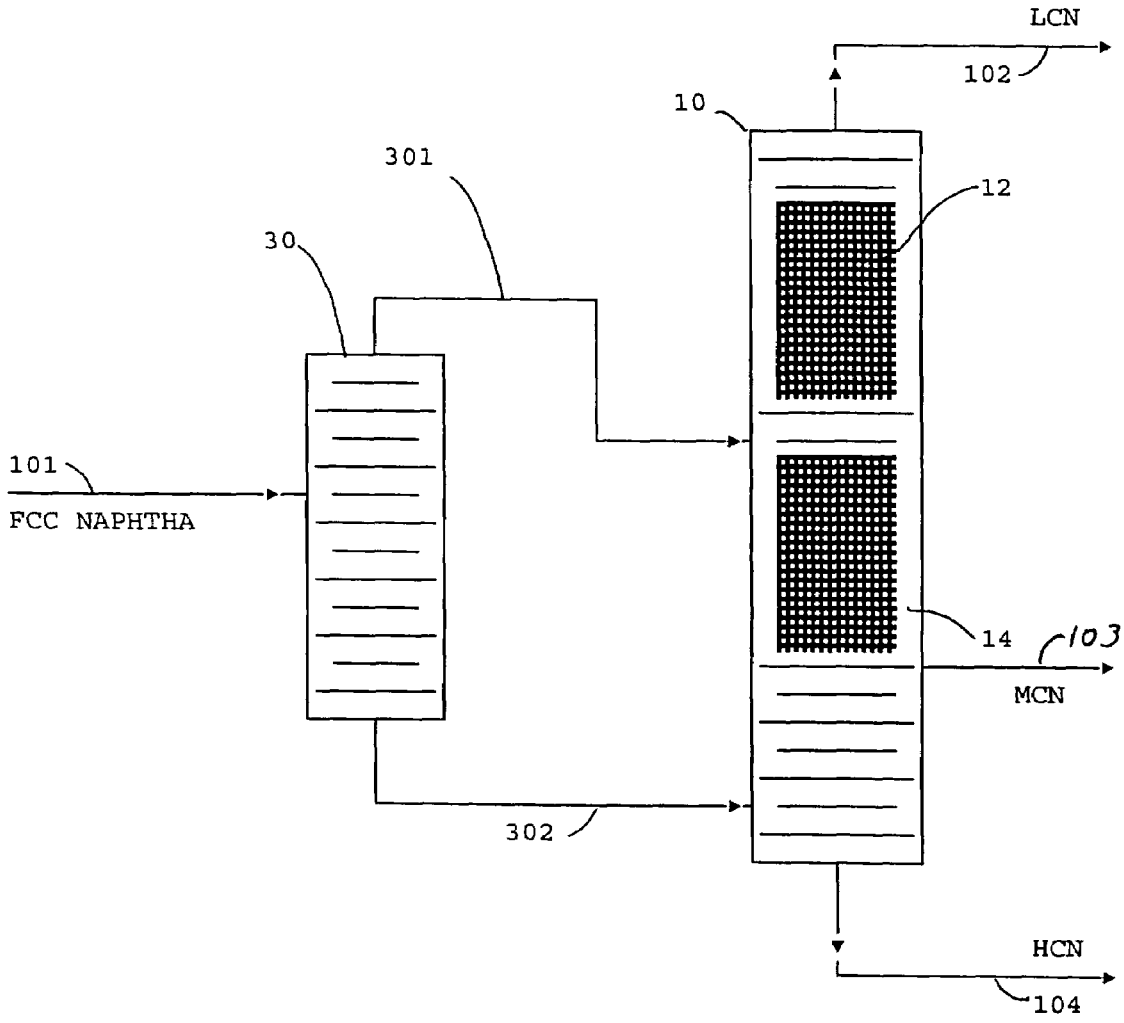
FIG. 6 is a flow diagram in schematic form of another embodiment of the present invention utilizing a single distillation column reactor having two catalyst beds and a pre fractionator which feeds the light fraction to the distillation column reactor between the beds and the heavy fraction below the beds.

The embodiments shown in FIGS. 5 and 6 are similar in that both include a splitter 30 prior to the distillation column reactor 10. The splitter 30 splits out the HCN as bottoms via flow line 302 with the remainder MCN and LCN taken as overheads via flow line 301. The LCN and MCN are fed between the two beds 12 (thioetherification) and 14 (selective hydrogenation) in the distillation column reactor 10. In the embodiment of FIG. 5 the HCN is removed as a separate stream so the beds 12 and 14 are placed in the upper and lower portions of the reactor 10 respectively. The treated LCN is removed as overheads via flow line 102 and the treated MCN is removed as bottoms via flow line 103. In FIG. 6 the HCN is fed to the bottom of the distillation column reactor so the beds 12 and 14 are located in the upper and middle portion of the reactor 10 respectively. The MCN is removed as a side draw via flow line 103 and the HCN is removed as bottoms via flow line 104.

What is claimed is:

1. A process for the treatment of fluid catalytic cracked naphtha containing dienes, mercaptans and other organic sulfur compounds, comprising the steps of:

(a) splitting the fluid catalytic cracked naphtha into at least three fractions comprising a light cracked naphtha, a medium cracked and a heavy cracked naphtha;

(b) treating the light cracked naphtha to react a portion of the mercaptans contained therein with a portion of the dienes contained therein in the presence of a thioetherification catalyst to form sulfides; and (c) treating the medium cracked naphtha to hydrogenate a portion of the dienes contained therein in the presence of a hydrogenation catalyst, wherein the medium cracked naphtha is not subjected to the thioetherification catalyst;

wherein steps (a) and (b) are carried out concurrently in a distillation column reactor having a thioetherification catalyst within the upper portion of the distillation column reactor, and the sulfides are removed with the medium and heavy cracked naphtha.

2. The process according to claim 1 wherein steps (a), (b) and (c) are carried out concurrently in a distillation column reactor having a thioetherification catalyst in the upper portion of the distillation column reactor and a hydrogenation catalyst in the middle portion of the distillation column reactor and the sulfides are removed in the medium cracked naphtha.

3. A process for the treatment of fluid cracked naphtha comprising the steps of:

(a) feeding hydrogen and a fluid catalytic cracked naphtha containing olefins, dienes, mercaptans and other organic sulfur compounds to a distillation column reactor containing a thioetherification catalyst in the upper portion thereof and a hydrogenation catalyst in the middle portion thereof (b) concurrently in said distillation column reactor, (i) splitting the fluid catalytic cracked naphtha into at least three fractions by fractional distillation, (ii) reacting a portion of the dienes with a portion of the mercaptans in the presence of the thioetherification catalyst to form sulfides, and (iii) reacting a portion of the dienes with hydrogen in the presence of the hydrogenation catalyst to produce mono olefins, (c) withdrawing a light cracked naphtha fraction from said distillation column reactor as overheads;

(d) withdrawing a medium cracked naphtha fraction from said distillation column reactor as a side draw; and (e) withdrawing a heavy cracked naphtha fraction from said distillation column reactor as a bottoms.

4. The process according to claim 3 wherein said distillation column is divided in the middle portion and part of the middle portion contains a hydrogenation catalyst and part of the middle contains distillation contact structure such that only a portion of the medium cracked naphtha is subjected to hydrogenation of the dienes contained therein.

5. The process according to claim 3 wherein said fluid catalytic cracked naphtha is fed to the bottom of said distillation column reactor.

6. A process for the treatment of fluid cracked naphtha comprising the steps of:

(a) feeding a fluid cracked naphtha containing olefins, dienes, mercaptans and other organic sulfur compounds to a naphtha splitter wherein a fraction containing the light cracked naphtha and medium cracked naphtha is removed as a first overheads and a fraction containing the heavy cracked naphtha is removed as a first bottoms;

(b) feeding the first overheads and hydrogen to a distillation column reactor containing a thioetherification catalyst in the upper portion thereof and a hydrogenation catalyst in the middle portion thereof (c) concurrently in said distillation column reactor, (i) splitting the first overheads into two fractions by fractional distillation, (ii) reacting a portion of the dienes with a portion of the mercaptans in the presence of the thioetherification catalyst to form sulfides, and (iii) reacting a portion of the dienes with hydrogen in the presence of the hydrogenation catalyst to produce mono olefins, (d) withdrawing a light cracked naphtha fraction from said distillation column reactor as a second overheads;

(e) withdrawing a medium cracked naphtha fraction from said distillation column reactor as a second bottoms.

7. The process according to claim 6 wherein said first bottoms is fed to said distillation column reactor near the bottom and said medium cracked naphtha is removed as a side draw and a heavy cracked naphtha is removed as a second bottoms.

* * * * *